US005159164A

United States Patent [19]

Koyanagi et al.

[11] Patent Number: 5,159,164

[45] Date of Patent: Oct. 27, 1992

[54] GAS CIRCUIT BREAKER

[75] Inventors: Osamu Koyanagi; Yasuharu Seki; Masanori Tsukushi, all of Hitachi, Japan

[73] Assignee: Hitachi, Ltd., Tokyo, Japan

[21] Appl. No.: 637,775

[22] Filed: Jan. 7, 1991

[30] Foreign Application Priority Data

Jan. 8, 1990 [JP] Japan ..... 2-536

[51] Int. Cl.[5] ..... H01H 33/88

[52] U.S. Cl. ..... 200/148 A; 200/148 B; 200/148 R

[58] Field of Search ..... 200/148 A, 148 B, 150 G, 200/148 R

[56] References Cited

U.S. PATENT DOCUMENTS

| | | | |
|---|---|---|---|
| 3,839,613 | 10/1974 | Tsubaki et al. | 200/148 A |
| 4,048,456 | 9/1977 | Noeske | 200/148 A |
| 4,070,558 | 1/1978 | Stewart et al. | 200/148 A |
| 4,163,131 | 7/1979 | Perkins | 200/148 A |
| 5,072,084 | 12/1991 | Seki et al. | 200/148 A |
| 5,079,392 | 1/1992 | Tsukushi et al. | 200/148 A |

FOREIGN PATENT DOCUMENTS

| | | |
|---|---|---|
| 2400252 | 3/1979 | France . |
| 257595 | 7/1986 | France . |

OTHER PUBLICATIONS

European Search Report EP 90 12 5737.

*Primary Examiner*—J. R. Scott

*Attorney, Agent, or Firm*—Antonelli, Terry, Stout & Kraus

[57] ABSTRACT

A gas circuit breaker comprising a pair of contactors separable from each other, an insulating nozzle surrounding the contact portions of the contactors so as to guide a flow of gas, and a puffer chamber for compressing the gas in conjunction with a separating operation of the contact portions so as to supply the gas, guided by the insulating nozzle from the puffer chamber through exhaust passage passing through a hollow portion of the movable one of the contactors located within the insulating nozzle. The exhaust passages are formed between the puffer chamber and one of the contactors. An exhaust gas guide opens through an end of an exhaust gas guide between the contact closing time and the time about which a movable contactor and a fixed contactor are to be separated at an initial stage, close during the initial stage of the separating operation and open afterward exhaust ports formed at ends of the exhaust passages located on a downstream side of the gas flow, there by making it possible to reduce the flow resistance to the gas flow used for arc extinguishment in cooperation with an arc-extinguishing gas flow passing through a throat portion of the insulating nozzle, to reduce a force required for operation and to reduce the size of the gas circuit breaker.

8 Claims, 9 Drawing Sheets

GAS CIRCUIT BREAKER

FIELD OF THE INVENTION

The present invention relates to a gas circuit breaker which opens a high-current electric circuit with use of gas, and more particularly, to a puffer type gas circuit breaker.

BACKGROUND OF THE INVENTION

The reducing of the operating power in a puffer type circuit breaker, which is at present the most widely used gas circuit breaker, has generally been done by employing a structure consisting of a combination of a puffer system and a self-actuated arc-extinguishing system in which the arc heat is positively utilized to increase the gas pressure and reduce the gas-compressing external force. In the puffer type circuit breaker, a double flow system in which a high pressure gas is blown against both the stationary portion and the movable portion is an essential technique for a large current circuit breaking operation. This kind of puffer type gas circuit breaker is disclosed, for instance, example, U.S. Pat. No. 3,839,613.

In accordance with these facts, a puffer type gas circuit breaking structure shown in FIGS. 1 to 3 in which a gas pressurized by arc heat is blown effectively against the arc by utilizing a double flow system has been proposed by the inventors of the present patent application.

Referring to FIGS. 1 to 3, an insulated or grounded closed metal container 1 has an interior 2 filled with an arc-extinguishing gas such as $SF_6$ gas. A shaft portion 5 of a fixed element body 4, of an electrically conductive material, is fixed at one end 6 thereof to an end wall 3 of the closed container 1. The fixed element body 4 includes a central fixed element portion or fixed arc contactor portion 9 extending in an axial direction A from the center of a flange portion 8 formed at the other end 7 of the shaft portion 5, and a hollow cylindrical main fixed element portion 10 extending from the circumferential edge of the flange portion 8 in the axial direction A.

A frame body 11 is stationarily fixed to the closed container 1 like the fixed element body 4. The frame body 11 has a cylindrical base portion 13 of large thickness having a central hole 12. A hollow cylindrical puffer piston portion 15 is formed so as to extend from a radially inner edge portion of an end portion 14 of the base portion 13 in an axial direction B. The cylindrical piston portion 15 has a hole 16 coaxial with and of the same diameter as that of the central hole 12. A cylindrical portion 17 of medium diameter is formed to extend from a radially outer edge portion of the end portion 14 of the base portion 13 in the axial, direction B, with a flange portion 18 extending radially outwardly from the end of the medium-diameter cylindrical portion 17, and an exhaust gas guide 19 of large diameter extending from the outer edge of the flange portion 18 in the axial direction B. circumferentially equidistantly, in the large-diameter exhaust gas guide 19 serving as block means, at the auxiliary predetermined position C thereof.

A movable part 21 of an electrically conductive material, is movable in the axial directions A and B with respect to the fixed element body 4. The movable part 21 has an operating shaft 24 fixed at one end 23 thereof to an operating device or actuator 22 and extends from the end 23 in the axial direction B while slidably passing through the holes 12, 16 of the frame body 11. The shaft portion 24 is formed at the other end 25 thereof with a hollow conical portion 26 extending radially outwardly from the end 25 in the direction B. The conical portion 26 is curved smoothly at a tip end 27 thereof for permitting gas to flow smoothly in a manner described more fully hereinbelow. An outer edge portion 28 of the conical portion 26 is bent radially outwardly and brought into gastight contact with an inner peripheral surface 29 of the large-diameter exhaust gas guide 19 of the frame body 11 in the closed state of FIG. 1. A cylindrical portion 31, serving as a puffer cylinder, extends from an intermediate portion of the inside surface of the conical portion 26 in the axial direction A and is fitted around the cylindrical piston portion 15 of the frame body 11 so as to define a cylindrical puffer chamber 30 in cooperation with the outer peripheral surface of the shaft portion 24. The conical portion 26 is formed with a hole 32 which opens into the chamber 30 so that, when the movable part 21 is moved in the direction A with respect to the frame body 11, the compressed gas flows out of the chamber 30 with the insertion of the piston portion 15 into the chamber 30 in the direction B.

Further, a hollow cylindrical movable contactor portion or movable arc contactor portion 33 is extends from the end of the shaft portion 24 in the axial direction B. The cylindrical movable contactor portion 33 is fitted around the central fixed element portion 9 in the inoperative state, that is, in the closed state (FIG. 1), and, when the movable part 21 is moved in the direction A with respect to the fixed element body 4, electric contact is released. The movable contactor portion 33 is formed in the outer peripheral surface thereof with concave portions 34 at a position close to the tip end, and ring springs 35 are provided in the concave portions 34. A space 36, defined inside the movable contactor portion 33 conically diverges at a part 37 thereof close to the curved end 27 of the shaft portion 24.

A cylinder 38 of large diameter, the tip end of which serves as a main movable element, extends in the axial direction B from the outer edge portion 28 of the conical portion 26. The large-diameter cylinder 38 of the movable part 21 is fitted in a gas-tight manner in the large-diameter exhaust gas guide 19 of the frame body 11. The large-diameter cylinder 38 is formed with a plurality of openings 39 circumferentially equidistantly at the position thereof in the vicinity of the outer edge portion 28. A passage 40, extending radially outwardly from the conical chamber 37 in the movable contactor portion 33, is formed between each of the openings 39 and the conical chamber 37. These passages 40 are defined by the conical portion 26 and a plurality of internal wall portions 41 each extending obliquely, so that each passage 40 is inclined with respect to the radial direction so as to smooth the flow of gas from the chamber 36. The passages 40 serve as exhaust passages, and the openings 39 serve as exhaust ports.

A nozzle 42, consisting of an electrically insulating material, comprises a hollow cylindrical large-diameter portion 43, a nozzle main body portion 45 of small diameter having a nozzle hole 44, and an intermediate portion 46 for connecting the large-diameter portion 43 with the main body portion 45. The nozzle hole 44 includes a cylindrical hole portion 47 as a throat portion into which the central fixed element portion 9 is fitted in a gas-tight manner, and a conical hole portion 48 extending outwardly therefrom. One end 49 of the large-diameter portion 43 of the nozzle 42 is brought into a gastight engagement with the inside groove formed in an expanded end portion 50 of the large-diameter cylindrical portion 38 of the movable part 21, so that the nozzle 42 cooperates with the large-diameter cylindrical portion 38, the internal wall portions 41, the conical portion 26 and the movable contactor portion 33 of the movable part 21 to define an expansion chamber 51 in which the gas heated and compressed by the arc is stored or accumulated.

In addition, the fixed element body 4 and the movable part 21 are arranged in series in an AC line of 50 to 60 Hz, for example, through terminals 52 and 53. In the inoperative (closed) state of a circuit breaker 60 of the above construction, an electric current flows between the terminals 52 and 53 through electrical connections between the central fixed element portion 9 and the movable contactor portion 33 which are in contact with each other and between the main fixed element portion 10 and the large-diameter cylindrical portion 38 of the movable part 21 which are in contact with each other as shown in FIG. 1.

In breaking the electrical connection between the terminals 52 and 53, the circuit breaker 60 is operated in the following manner.

First, upon receipt of an instruction (signal) to interrupt the current, the operating device 22 is actuated to cause the shaft portion 24 of the movable part 21 to move in the direction A with respect to the fixed element body 4 and the frame body 11. This movement first breaks the electrical connection between the main fixed element portion 10 and the large-diameter cylindrical portion 38 of the movable part 21, but the central fixed element portion 9 and the movable contactor portion 33 are kept in contact with each other. The movement of the movable part 21 in the direction A causes the cylindrical piston portion 15 of the frame body 11 to be moved relatively into the puffer chamber 30 in the direction B, so that the pressure of gas in the puffer chamber 30 and the expansion chamber 51 communicated therewith is increased.

Further movement of the shaft portion 24 in the direction A causes the central fixed arc contactor portion 9 to slip out of the movable contactor portion 33, thus starting parting of the movable contactor portion 33 from the central fixed arc contactor portion 9. As a result, the arc discharge 61 starts to take place between the central fixed arc contactor portion 9 and the movable contactor portion 33. During an initial stage of such breaking operation, the central fixed arc contactor portion 9 still closes the hole 47 of the nozzle 42 so that relative insertion of the cylindrical piston portion 15 of the frame body 11 into the puffer chamber 30 in the direction B causes the increase of the pressure of the gas not only in the puffer chamber 30 and the expansion chamber 52 but also in the chamber 36 defined inside the movable contactor portion 33 in communication with the expansion chamber 51 and the exhaust passages 40 the openings 39 of which are closed by the cylindrical portion 38 serving as the block means. In addition, the arc 61 produced between the central fixed arc contactor portion 9 and the movable contactor portion 33 causes the gas in the expansion chamber 51 and the chamber 36 inside the movable contactor portion 33 to be heated, resulting in the increase of the pressure of the gas in the expansion chamber 51.

In case that the electric current to be interrupted is relatively small, since the arc 61 heats the gas to a relatively low degree, the gas is not so much heated nor compressed by the arc 61 but the gas in the chambers 30, 51, 36 and 40 has been compressed to reach a certain level of pressure due to insertion of the piston 15 into the puffer chamber 30. Consequently, as shown in FIG. 2, when a further movement of the movable part 21 in the direction A causes the central fixed arc contactor portion 9 to slip out of the throat-like cylindrical hole 47 of the nozzle 42, the gaseous plasma of the arc discharge 61 is cooled by the gas flow 62 flowing out of the expansion chamber 51 through the throat-like hole portion 47, that is, by means of pufferring of the gas flow 62, resulting in that the electric resistance in this gaseous region is increased to extinguish the arc discharge 61 at a timing close to the zero-cross point of an instantaneous magnitude of AC electric current where the arc 61 is thin, thereby breaking the electrical connection between the central fixed arc contactor portion 9 and the movable contactor portion 33.

In the circuit breaker 60, since no exhaust passage is formed in the shaft 24, unlike the conventional circuit breakers, the shaft 24 can be formed relatively small in diameter. In addition, only a small amount of gas is required for pufferring in regard to a small current, so that the diameter of the puffer chamber 30 formed around the shaft 24 of relatively small diameter can be made relatively small as well, resulting in that the cross-sectional area of the puffer chamber 30 is reduced and, therefore, the operating force exerted by the operating device 22 can be reduced.

On the other hand, in case that the electric current to be interrupted is large, the gas continues to be heated and compressed by the arc 61 until the central fixed arc contactor portion 9 slips out of the throat hole portion 47 of the nozzle 42 as shown in FIG. 2, and however, it is impossible to extinguish the arc 61 by cooling it using only pufferring of the gas flow 62 passing through the throat hole portion 47 of the nozzle 42. However, when the movable part 21 is further moved in the direction A to bring the breaking operation in its intermediate stage as shown in FIG. 3, the central fixed arc contactor portion 9 comes out of the conical hole 48 of the nozzle 42 and the exhaust ports 39 of the exhaust passages 40 are moved to the position C so as to be perfectly communicated with the openings 20 of the large-diameter cylindrical portion 19 as the block means. Consequently, the gaseous plasma of the arc discharge 61 is cooled by two gas flows, that is, double flows including the gas flow 62 flowing through the throat-like hole portion 47 from the puffer chamber 30 and the expansion chamber 51 the pressure in which has been increased and the gas flow 63 flowing from the expansion chamber 51 through the chamber 36, the exhaust passages 40 and the openings 39, resulting in that the electric resistance in this arc region is increased to extinguish the arc 61 at a timing close to the zero-cross point of the instantaneous magnitude of AC electric current, thus breaking the electrical connection between the central fixed element portion 9 and the movable contactor portion 33. The time from receipt of breaking instruction to extinguishment of the arc 61 is substantially equal to the time during which the instantaneous AC current value becomes zero twice (about 1/50 to 1/60 sec., for example).

In the circuit breaker 60, since the exhaust passages 40 are arranged to extend radially outwardly between the movable contactor portion 33 and the puffer chamber 30, unlike the conventional circuit breakers, the length of the exhaust passage 40 can be reduced independently of the length of the puffer chamber 30. Consequently, the flow resistance of the exhaust passage 40 to the gas flow 63 discharged through the exhaust passages 40 and the openings 39 can be reduced so that the gas flow 63 can be made sufficiently large at the timing shown in FIG. 3, thereby assuring more reliably the extinguishment of the arc 61 using the gas flow 63 in cooperation with the gas flow 62.

In the circuit breaking operation in the early stage shown in FIG. 2, an arc 61 occurs between the fixed are contactor portion 9 and the movable contactor 33, and an arc-extinguishing gas in the cylinder, 38 and the puffer chamber 30 is thereby heated. Since the opening 39 on the side of the movable contactor 33 is closed by the exhaust gas guide 19, a wasteful gas flow does not occur at this time.

In the circuit breaking operation in the intermediate stage shown in FIG. 3, when the fixed arc contactor portion 9 out of the insulating nozzle 42, the opening 39 on the side of the movable portion also comes out of the exhaust gas guide 19, and gas flows in the both directions occur simultaneously to extinguish the arc 61.

According to the gas circuit breaker shown in FIGS. 1 to 3, the double flow system capable of carrying out an effective gas blowing operation can be obtained by virtue of the decrease in the flow passage resistance and the increase in the degree of freedom of setting the surface areas of the flow passage and opening 39, which are attributed to the success in reducing the length of the gas flow passage 40 on the side of the movable section.

However, the gas circuit breaker shown in FIGS. 1 to 3 has the following drawback encountered when the voltage in the circuit breaking section needs to increased and the size needs to be reduced.

In order to increase the voltage in the circuit breaking section, it is necessary that the distance L between the main stationary member 10 and the exhaust gas guide 19 in a circuit breaking state must be large as shown in FIG. 3. However, in order to increase the distance L, the positions of the front end of the exhaust gas guide 19 and the opening 39 have to be shifted to the side of the movable section. This causes the longitudinal length of the circuit breaking structure to increase. This contradicts the requirement the circuit breaking section must be reduced. Furthermore, the length of the gas flow passage 40 also increases, so that the flow passage resistance increases and the circuit breaking performance lowered.

Additionally, the fixed arc contactor portion 9, the movable contactor 33 and the insulating nozzle 42 can not easily be replaced because the distance L is too short, and the opening 39 cannot easily be inspected.

SUMMARY OF THE INVENTION

An object of the present invention is to provide a gas circuit breaker capable of increasing the voltage of a circuit breaking section and miniaturizing the same, and having a stable circuit breaking performance.

The object can be achieved by shifting the front end of the exhaust guide to the movable side so as to open the opening, which is provided in the side surface of the cylinder, between the contact closing time and the time about which the electrodes of the movable and stationary contactors are separated.

Even when the opening is opened between the contact closing time and the time about which the contactors are separated in the initial stage of the circuit breaking operation, a gas flow from the movable contactor does not substantially occur, so that a wasteful discharge of gas does not occur in that period of time. Therefore, the increasing of distance between the exhaust gas guide and a hollow cylindrical main fixed element portion mentioned later and of the voltage of the circuit breaking section can be accomplished without causing an increase in the size of the circuit breaking section and a decrease in the circuit breaking performance.

DETAILED DESCRIPTION

Figure 1:
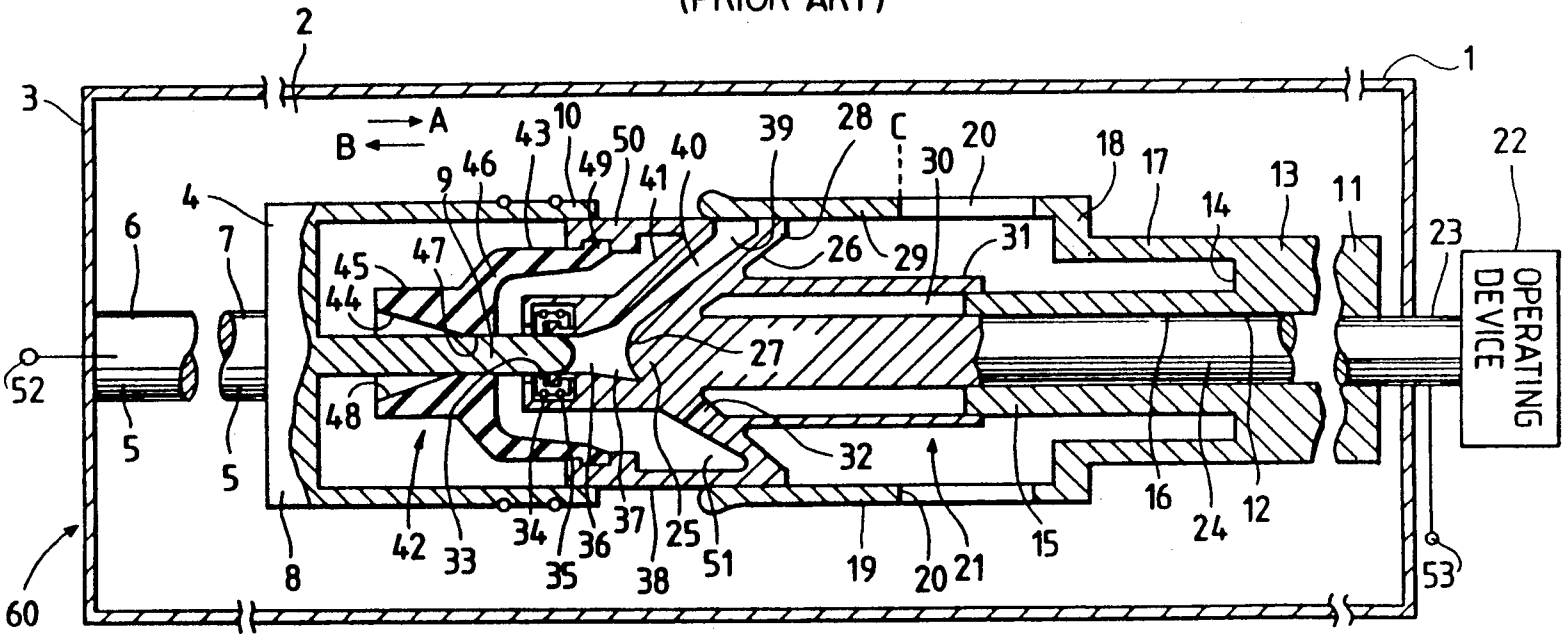
FIG. 1 (PRIOR ART)
FIG. 1 is a longitudinal cross-sectional view of a gas circuit breaker previously proposed by the inventors of the present application, in a closed state.
Figure 2:
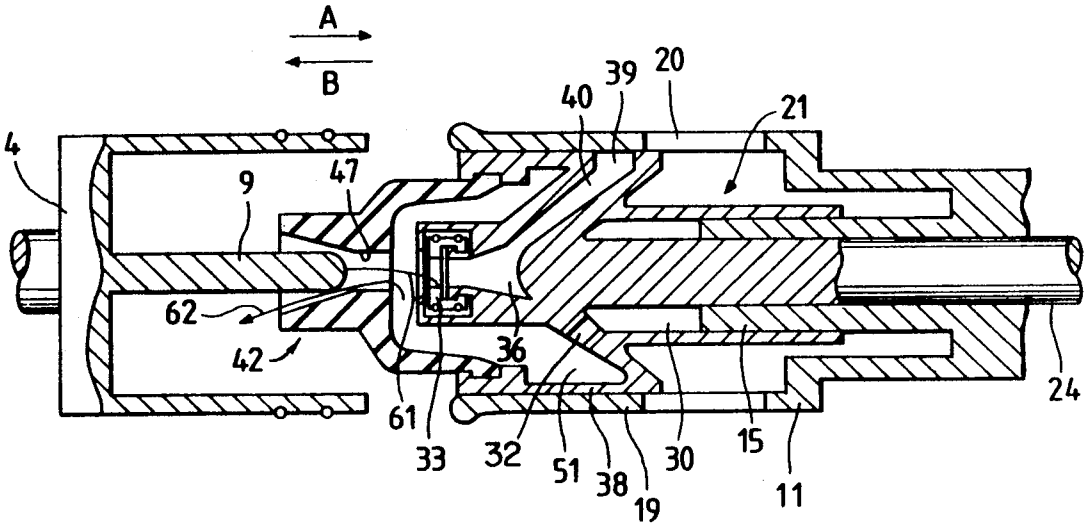
FIG. 2 (PRIOR ART)
FIGS. 2 and 3 are cross-sectional views of the gas circuit breaker of FIG. 1 respectively depicting an initial stage and an intermediate stage of a breaking operation.
Figure 3:
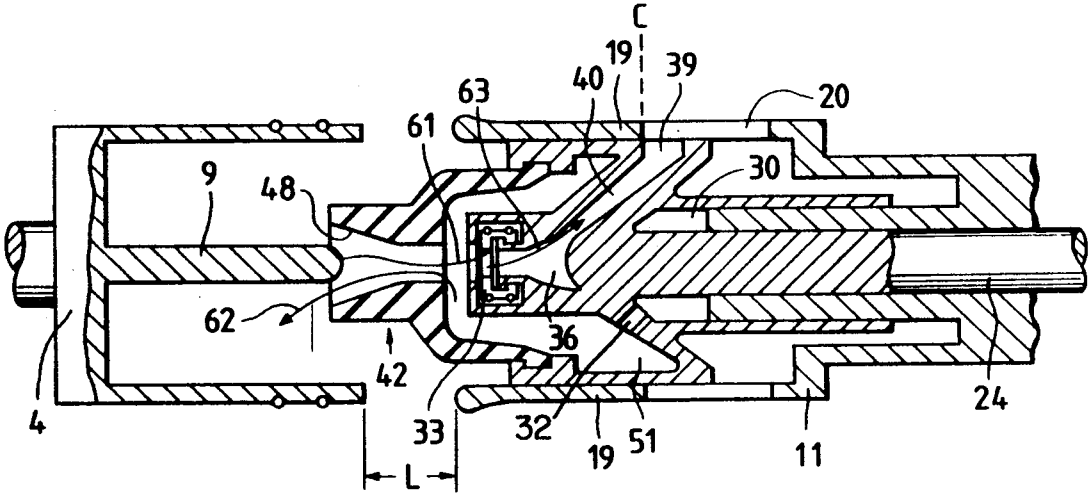
FIG. 3 (PRIOR ART)
Figure 4:
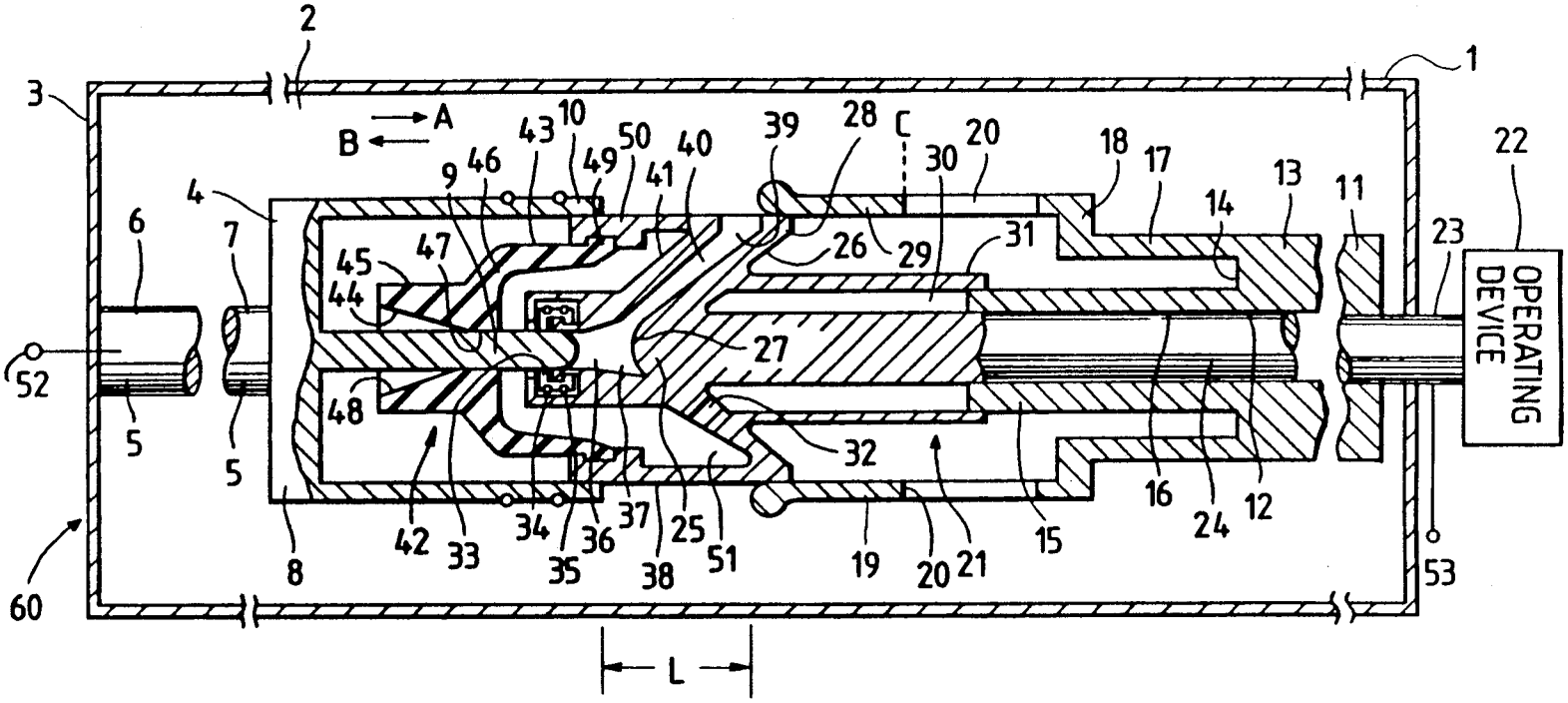
FIG. 4 is a longitudinal cross-sectional view of a gas circuit breaker according to a first embodiment of the present invention, in a contact-closed state.

Referring now to the drawings wherein like reference numerals are used throughout the various views to designate like parts and, more particularly, to FIG. 4, according to this Figure, as compared with the construction of FIGS. 1–3, a front end of an exhaust gas guide 19 is shifted to a side of the movable section, and an opening 39 is opened in a closed state. The opening 39 is closed by the exhaust gas guide 19 immediately before or immediately after the fixed arc contactor portion 9 and the movable contactor 33 are separated. The circuit breaking operation thereafter is carried in the same manner as in the circuit breaker described in connection with FIGS. 1-3.

By this construction, even when the opening 39 is opened between the contact closing time and the time about which the electrodes of the fixed arc contactor portion 9 and the movable contactor 33 are separated in the circuit breaking operation, a gas flow from the nozzle 45 in the movable contactor 33 does not substantially occur. Thus, since a wasteful gas flow which deteriorates the circuit breaking performance does not occur, the length L between the exhaust gas guide 19 and the main fixed element portion 10 and the voltage in the circuit breaking section can be increased without affecting the circuit breaking performance. For example, when the pole distance length L between the exhaust gas guide 19 and the main fixed element portion 10 shown in FIG. 6 becomes greater than 1.4 times as compared with the pole distance length L shown in FIG. 3, the insulation performance between the poles of the exhaust gas guide 19 and the main fixed element portion 10 shown in FIG. 6 becomes larger approximately 1.4 times compared with that of FIG. 1.

Figure 5:
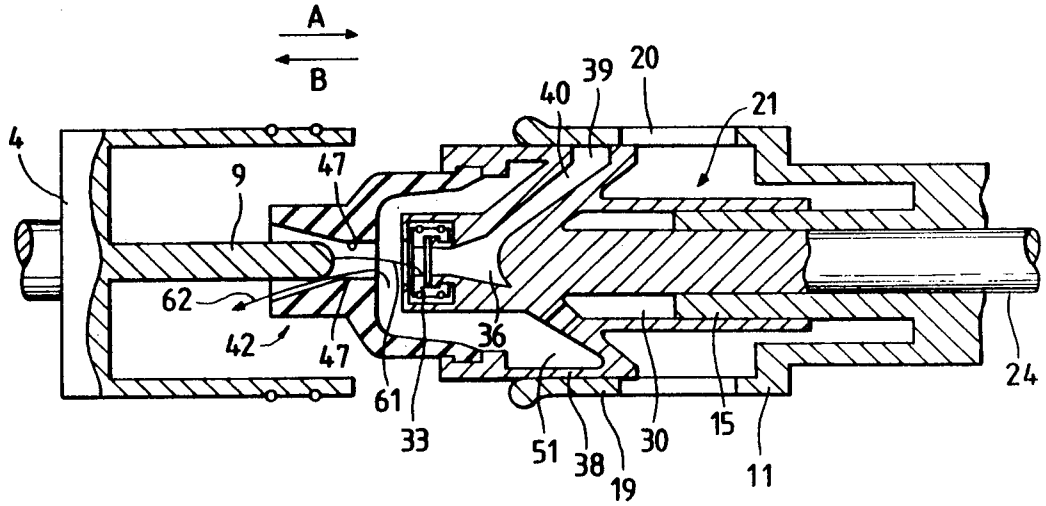
FIGS. 5 and 6 are partial longitudinal cross-sectional views of the gas circuit breaker of FIG. 4 respectively depicting an initial stage and intermediate stage of a breaking operation.
Figure 6:
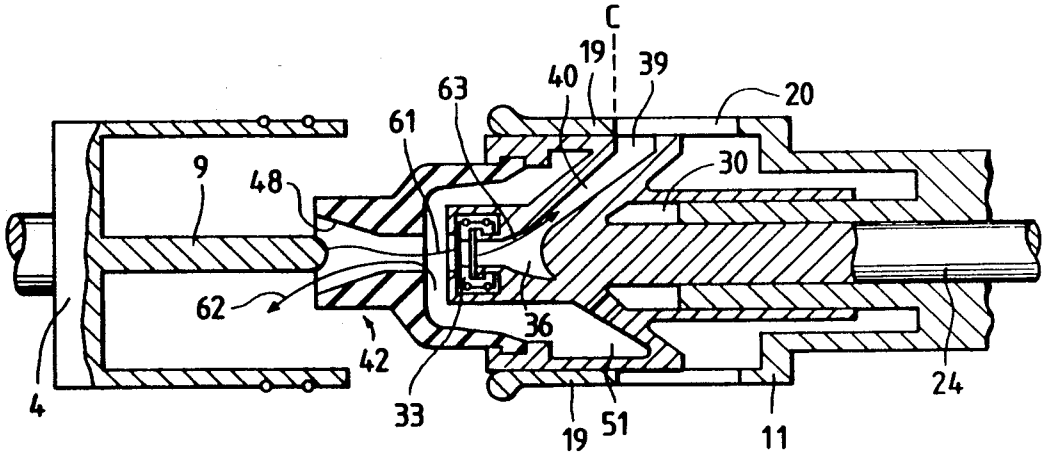

In FIGS. 4 to 6, the movable part 21 is illustrated as being a single body in practice except the insulating nozzle 42. However, the movable part 21 may be an assembly of parts suitable to manufacture and assemble.

The movable part 21*a*, as shown in FIGS. 7-10, comprises four electrically conductive members 71, 72, 73 and 74 and an insulating nozzle 42, with first member 71 mainly forming a shaft portion 24 and a movable contactor portion 33. The movable contactor portion 33 of the first member 71 is formed circumferentially equidistantly with a plurality of (three or four, for example) notched portions 40*a* which partially form exhaust passages 40. The second member 72 mainly forms an outer peripheral wall or puffer cylinder 31 of a puffer chamber 30 and a conical wall portion 26 which partially forms the exhaust passages 40 and expansion chambers 51. The wall portion 26 is formed, in parts thereof which define the expansion chambers 51, with holes circumferentially equidistantly which serves as passages 32 for communicating the puffer chamber 30 with the expansion chambers 51. The expansion chambers 51, the holes 32 and the exhaust passages 40 are equal in number to each other. Further, in a part of this example a radially outer end portion 28 of the conical wall portion 26 does-not extend perpendicularly but obliquely to the axial direction. The third member 73 includes an umbrella-shaped member which mainly serves to partially form the peripheral walls of the exhaust passages 40. Convex portions of the bevel member form wall portions 41 of the exhaust passages 40, and concave portions thereof are closely put on the conical portion 26 of the second member 72 to form the wall portions of the expansion chambers 51. The convex portions forming the wall portions 41 are formed at circumferential positions where they exactly coincide with the notched portions 40*a* of the first member 71. The fourth member 74 serves to support in an air-tight manner, the insulating nozzle 42 by a portion of the inner peripheral wall of a cylinder 38 serving as the main movable element as well as to mainly form the expansion chambers 51. The fourth member 74 is put on the conical portion 26 of the second member 72 so as to exactly cover the movable contactor portion 33 of the first member 71 and the third member 73. The fourth member 74 is formed with notched portions 39*a* which correspond to the exhaust ports 39 at circumferential positions corresponding to the exhaust passages 40.

Figure 7:
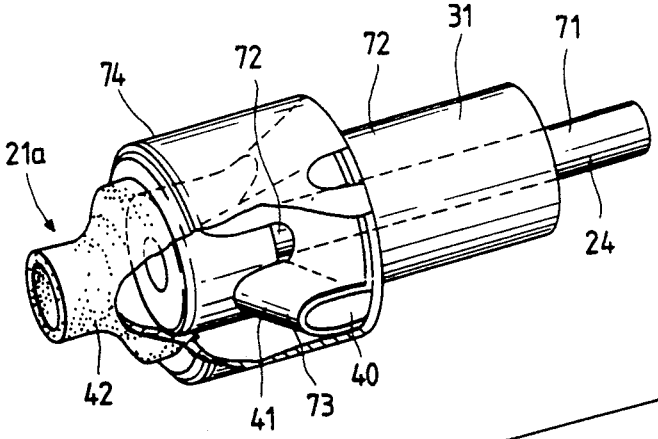
FIG. 7 is a partially broken-away perspective view of the gas circuit breaker of FIG. 4 illustrating an example of a movable part thereof.
Figure 8:
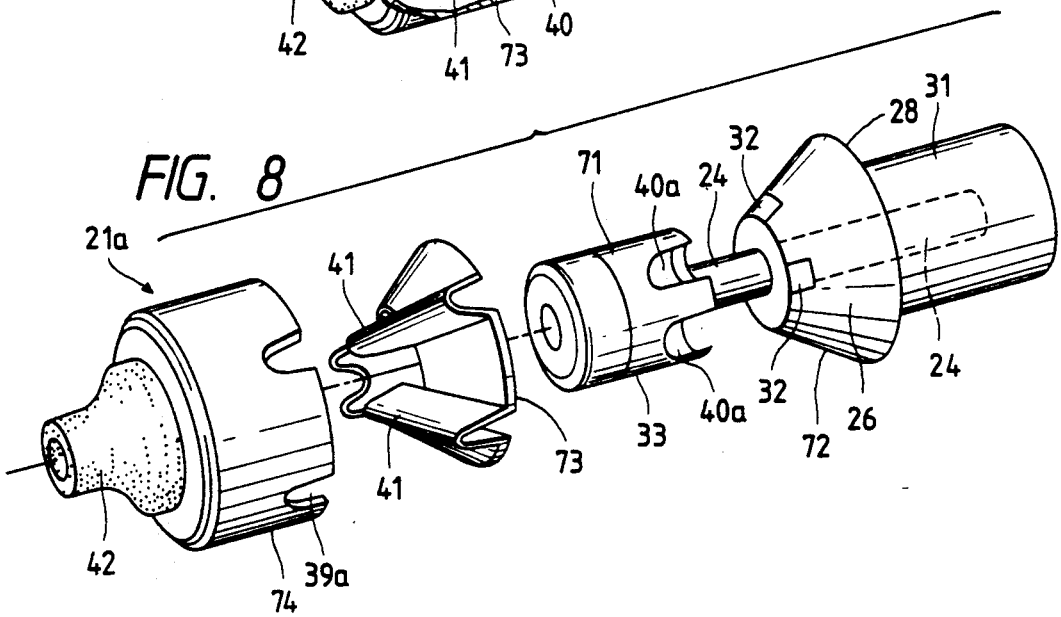
FIG. 8 is an exploded perspective view of the gas circuit breaker of FIG. 7.
Figure 9:
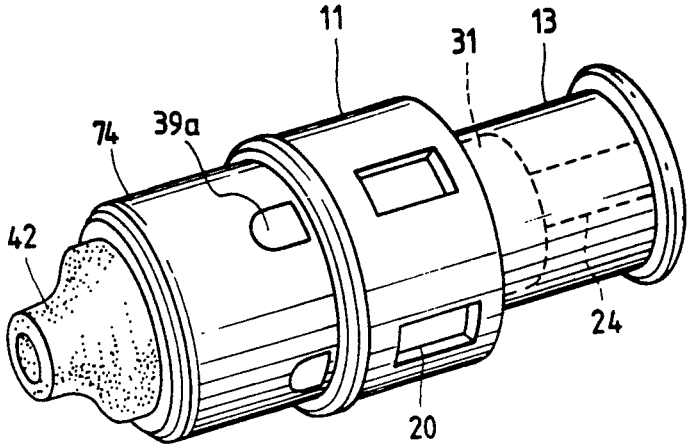
FIG. 9 is a perspective view of the entire movable part and exhaust gas guide of the gas circuit breaker of FIG. 4.
Figure 10:
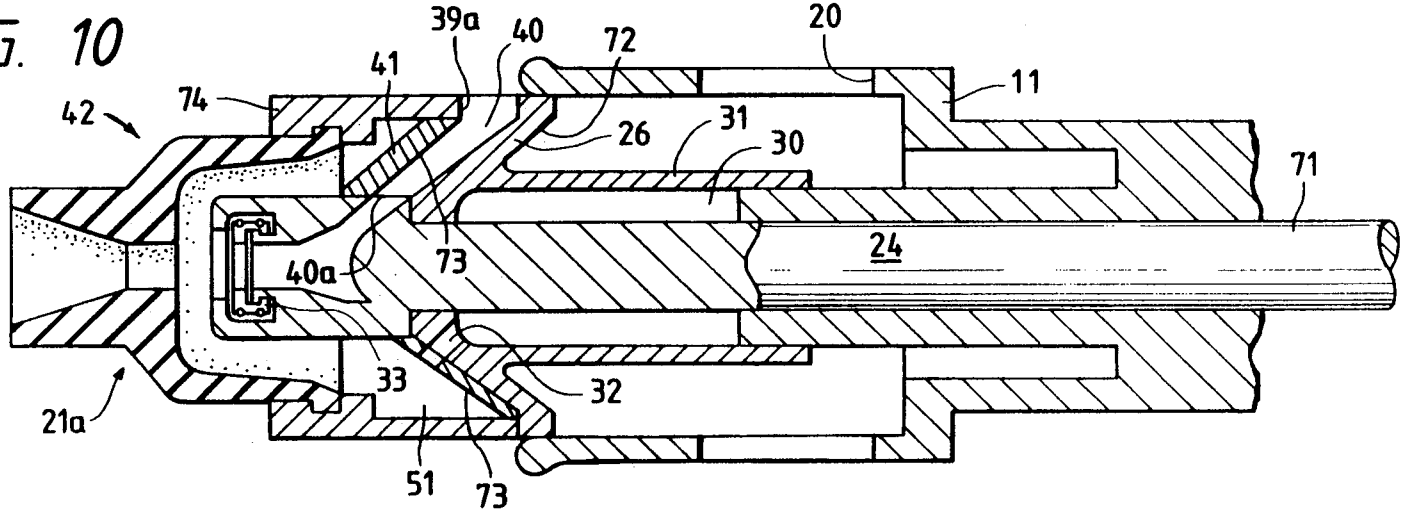
FIG. 10 is a partial longitudinal cross-sectional view of a gas circuit breaker according to another embodiment of the present invention.

FIG. 10 shows an example in which the frame body 11 and the movable part 21*a* of the circuit breaker are formed by the elements shown in FIGS. 7 to 9.

Figure 11:
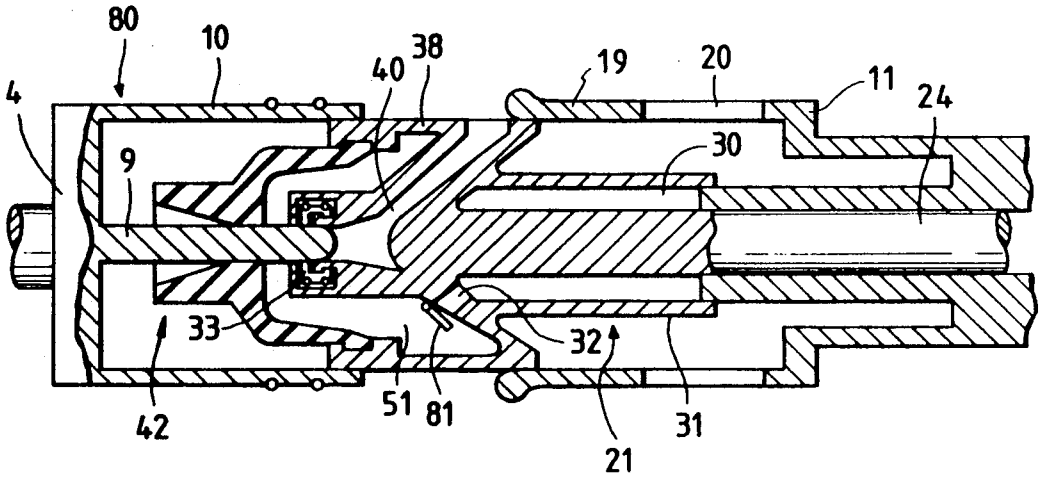
FIG. 11 is a partial longitudinal cross-section view of a gas circuit breaker according to yet another embodiment of the present invention.

In the gas circuit breaker 80 of FIG. 11, the passage 32 for communicating the puffer chamber 30 with the expansion chamber 51 is provided with a check valve 81, with the check valve 81 being constructed so as to permit the gas to flow from the puffer chamber 30 into the expansion chamber 51 but prevent the gas to flow from the expansion chamber 51 into the puffer chamber 30.

Consequently, in interrupting the electric current, when the gas pressure in the expansion chamber 51 is higher than that in the puffer chamber 30, since the check valve 81 is closed, the compressed gas in the expansion chamber 51 is first used for pufferring against the arc 61. Namely, the compressed gas in the expansion chamber 51 serves as the source of cooling flows 62 and 63 along the arc 61. This pufferring of the cooling flows 62 and 63 causes the gas pressure in the expansion chamber 51 to become lower than the gas pressure in the puffer chamber 30. Then the check valve 81 is opened to allow the gas pufferring cooling flows 62 and 63 to be released from the puffer chamber 30. Accordingly, the duration of gas pufferring for extinguishment of the arc 61 is longer as compared with the gas circuit breaker 60 with no check valve 81, thereby assuring the extinguishment of the arc 61 more reliably. In addition, as the pressure in the puffer chamber 30 is not increased even when the pressure in the expansion chamber 51 is increased upon interrupting large electric current, the reaction force against operation of the shaft 24 can be reduced.

Figure 12:
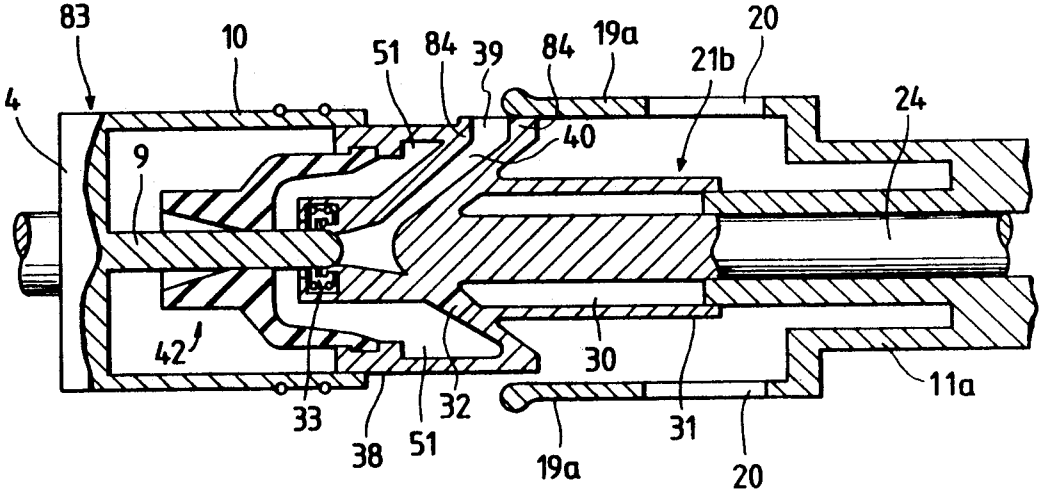
FIG. 12 is a partial longitudinal cross-sectional view of a gas circuit breaker according to a further embodiment of the present invention.

In the gas circuit breaker 83 of FIG. 12, a peripheral wall of the exhaust port 39 of each of the exhaust passages 40 is formed by an annular projection 84 projecting in radial direction of the shaft 24. Namely, the annular projection 84 is formed around each of the exhaust ports 39 in the large-diameter cylinder 38 of a movable part 21*b* corresponding to the movable part 21 of FIG. 4. This increases the radius of a large-diameter cylindrical cylinder 19*a* of a frame body 11*a*, corresponding to the large-diameter cylinder 19 of the frame body 11 of FIG. 1, by an amount corresponding to the radial height of the projection 84. The annular large-diameter cylinder 19*a*, therefore, is brought into a sliding contact only with the projecting ends of the annular projections 84 formed circumferentially equidistantly on the movable part 21*b*, thus opening and closing the exhaust ports 39. As a result, the slide contact area of the movable part 21*b* can be made smaller than that of the movable part 21, thereby making it possible to reduce the sliding resistance of the movable part 21*b*.

Figure 13:
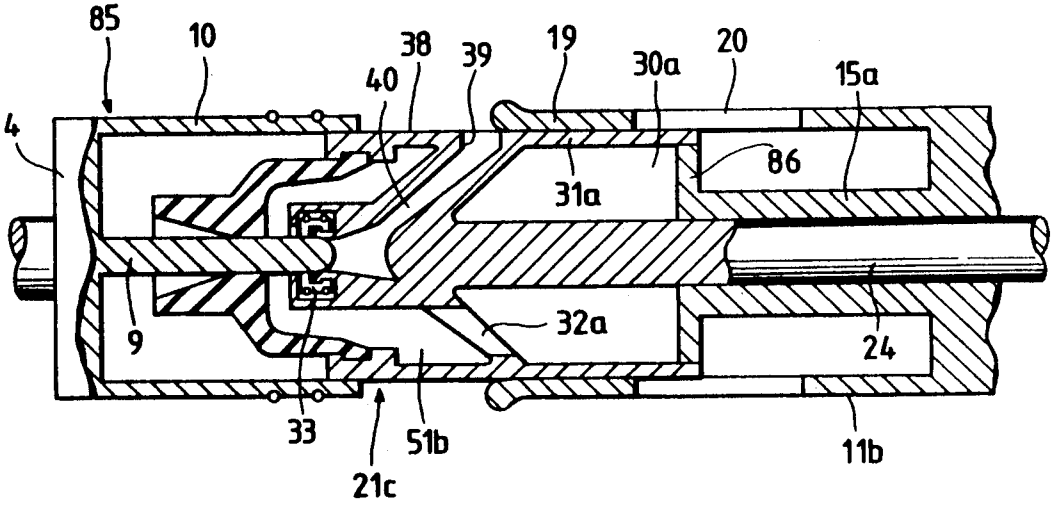
FIG. 13 is a partial longitudinal cross-sectional view of a gas circuit breaker according to a still further embodiment of the present invention.

In the gas circuit breaker 85 of FIG. 13, a cylindrical portion 31*a* of a movable element 21*c*, corresponding to the cylindrical portion 31 of the movable part 21 of FIG. 4, has a large diameter so as to be brought into sliding contact with the large-diameter cylinder 19 of the frame body 11. Therefore, a puffer chamber 30*a* has a large diameter as well, and a piston main body portion 86 of the frame body 11*b* which is inserted into the puffer chamber 30*a* is formed at the tip end of a hollow shaft piston portion 15*a*. In addition, a hole 32*a* formed in the conical wall 26 defining the end portion of the puffer chamber 30*a* has a large diameter as well. The construction of the embodiment of FIG. 13 is more simple than the constructions of the other embodiments mentioned above.

In addition, the main fixed element 10 can be dispensed with. In this case, the cylindrical portion of the movable member 21 does not function as the main movable element but functions as the wall for defining the expansion chamber.

Figure 14:
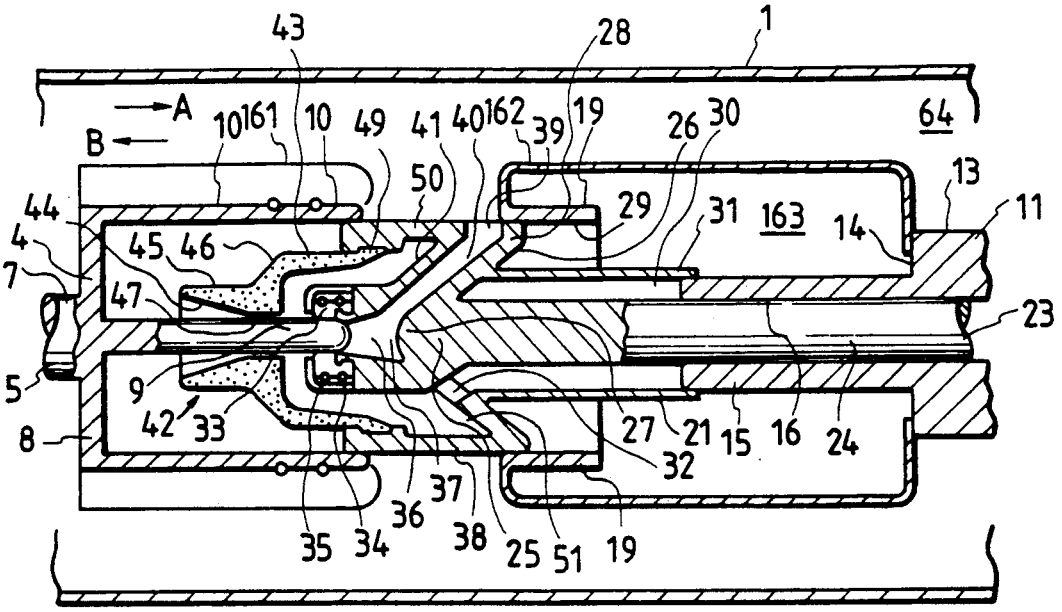
FIG. 14 is a partial longitudinal cross-sectional view of the gas circuit breaker according to another embodiment of the present invention.
Figure 15:
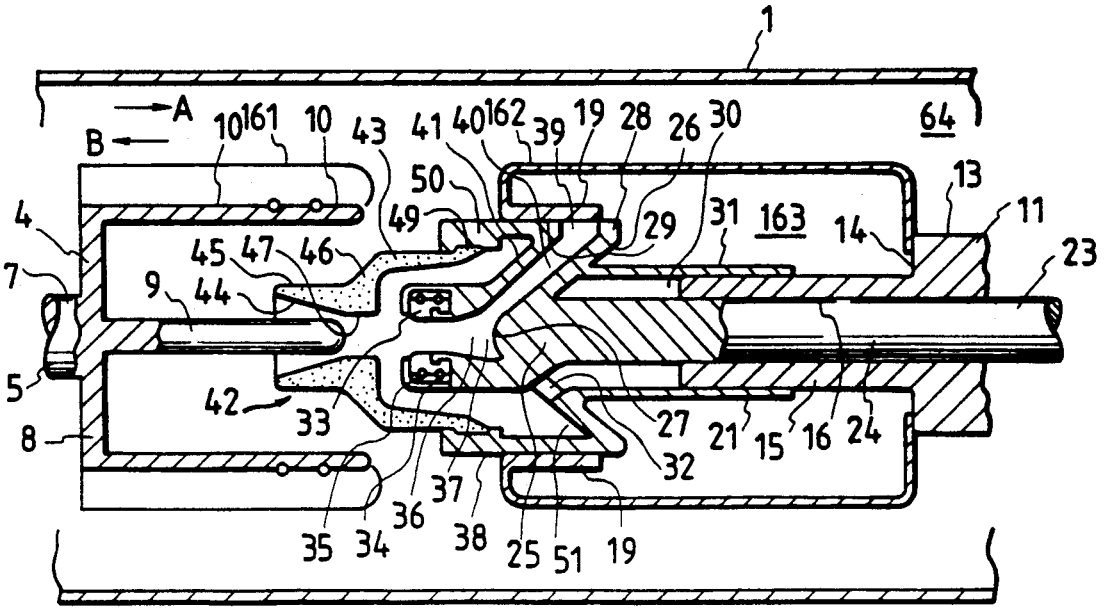
FIGS. 15 and 16 are partial longitudinal cross-sectional views of the gas circuit breaker of FIG. 14 respectively depicting an initial stage and intermediate stage of a breaker operation.
Figure 16:
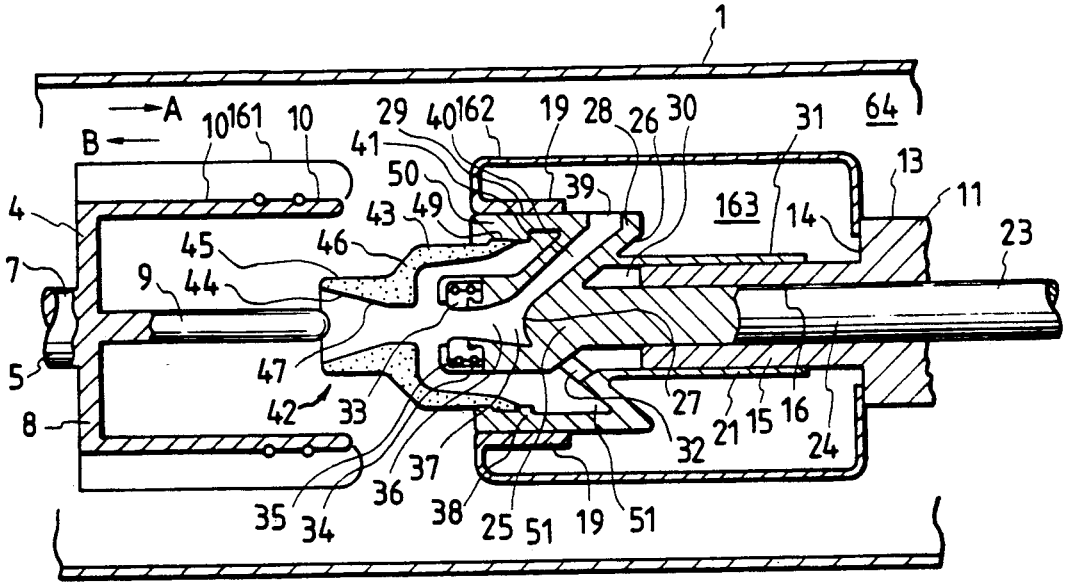

The embodiment of the present invention shown in FIGS. 14 to 16, illustrated in a contact-closed state like the embodiment of FIG. 2, differs from the above-described embodiments in that a shield 161 is provided around a main stationary member 10, and a gas shield 162 is formed integrally in one piece with an exhaust gas guide 19. The insulator or ground metal container 1 includes gas spaces 63, 64. It is generally known to provide a gas circuit breaker with a shield used to alleviate the electric fields between the exhaust gas guide 19 and the hollow cylindrical main fixed element portion 10, and a gas shield used to prevent high-temperature gas discharged during a large-current circuit breaking operation from damaging the container 1, or dielectric breakdown from occurring, with a view to increasing the voltage in the circuit breaker. The embodiment of FIGS. 14–16, in which the exhaust gas guide 19 and the gas shield 162 are formed integrally in one piece, enables a reduction in the number of parts required.

Figure 17:
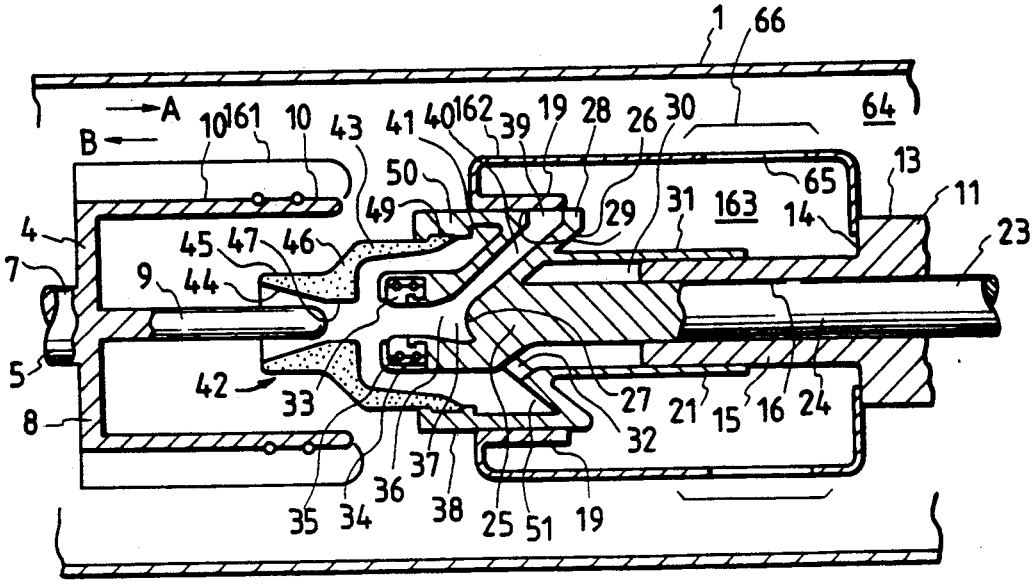
FIG. 17 is a partial longitudinal cross-sectional view of a gas circuit breaker according to still another embodiment of the present invention.

The embodiment of FIG. 17 shown in an intermediate stage of a circuit breaking operation differs from the embodiment of FIG. 16 in that a gas shield 162 is provided with exhaust bores 65 with a gas shielding member 66 provided on the outer side of these bores.

In a circuit breaking structure to which the present invention is applied, the gas flow passage extending from a movable contactor 33 from which an arc is formed to an opening 39 via a nozzle 45 and a gas flow passage 40 is shortened. Accordingly, the gas is not substantially cooled with the circumferential members, and high-temperature gas is discharged in a gas space 163. Consequently, the pressure in the gas space 163 increases, and the flow rate of the gas from the opening 39 is restricted, so that the circuit breaking performance is lowered. If exhaust bores 65 are provided in a gas shield 162 with a gas shielding member 66 on the outer side of the exhaust bores 65 as shown in FIG. 17, an increase in the pressure in the gas space 163, damage to container 1 due to a high-temperature gas flow from the gas space 163 to the gas space 64, and the dielectric breakdown between the circuit breaking structure and the container 1 can all be prevented.

According to the present invention, the anode-cathode distance can be increased without adversely affecting the circuit breaking performance, so that a gas circuit breaker capable of increasing the voltage in the circuit breaking section to a high level and having a stable circuit breaking performance can be provided.

What we claim is:

1. A gas circuit breaker comprising:

a fixed contactor and a movable contactor adapted to be separated from each other;

a nozzle of an electrically insulating material surrounding said contactors so as to guide a flow of gas;

a cylinder forming a unitary body together with said movable contactor and said nozzle and forming a puffer chamber for compressing a gas therein upon a separating of said contactors;

an exhaust gas guide gastightly contacting on said cylinder and compressing the gas at said puffer chamber upon the separating of said contactors so as to blow said gas from said puffer chamber to said nozzle and exhaust said gas through an exhaust passage passing through a hollow portion of said movable contactor, said exhaust passage being formed between said puffer chamber and said movable contactor; and wherein an exhaust port, formed at an end of said exhaust passage located on a downstream side of the gas flow, is opened to a gas space within the circuit breaker housing through an end of said exhaust gas guide between a closing time of said contactors and a time about which said movable contactor and said fixed contactor are separated at an initial stage, is closed during the initial stage and opened subsequently at an intermediate stage of the circuit breaking operation.

2. A gas circuit breaker according to claim 1, wherein said exhaust gas guide includes a gas shield plate.

3. A gas circuit breaker according to claim 2, wherein said gas shield plate includes an exhaust bore.

4. A gas circuit breaker according to claim 1, wherein said exhaust gas guide includes an exhaust port for exhausting said gas from said puffer chamber through said exhaust passage.

5. A gas circuit breaker comprising:

a fixed contactor and a movable contactor adapted to be separated from each other;

a nozzle of an electrically insulating material surrounding said contactors so as to guide a flow of gas;

a cylinder forming a unitary body together with said movable contactor and said nozzle, having an operating shaft thereof and forming a puffer chamber for compressing a gas therein in conjunction with a separating operation of said contactors;

a frame body comprising an exhaust gas guide gastightly contacting on said cylinder, a cylindrical portion connected to the exhaust guide and extending to an opposite direction to said fixed contactor along an axial direction of said operating shaft, and a hollow cylindrical puffer piston for guiding a movement of said operating shaft, wherein the gas from said puffer chamber is compressed upon a separating of said contactors so as to blow said gas from said puffer chamber to said insulating nozzle and exhaust said gas through an exhaust passage passing through a hollow portion of said movable contactor, said exhaust passage being formed between said puffer chamber and said movable contactor, an exhaust port, formed at end of said exhaust passage located on a downstream side of the gas flow, is opened to a gas space within the circuit breaker housing through an end of said exhaust gas guide between a closing time of the contactors and a time about which said movable contactor and said fixed contactor are separated at an initial stage, is closed during the initial stage and subsequently opened at an intermediate stage of the circuit breaking operation.

6. A gas circuit breaker according to claim 5, wherein said exhaust gas guide includes a gas shield plate.

7. A gas circuit breaker according to claim 6, wherein said gas shield plate includes an exhaust bore.

8. A gas circuit breaker according to claim 5, wherein said exhaust gas guide includes an exhaust port for exhausting said gas from said puffer chamber through said exhaust passage.

* * * * *